US006238139B1

(12) United States Patent
Glang et al.

(10) Patent No.: US 6,238,139 B1
(45) Date of Patent: May 29, 2001

(54) SEALING ARRANGEMENT

(75) Inventors: Siegfried Glang, Hamburg; Werner Grabe, Winsen, both of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 08/823,654

(22) Filed: Mar. 7, 1997

Related U.S. Application Data

(63) Continuation of application No. 08/302,644, filed as application No. PCT/DE94/00010 on Jan. 7, 1994, now abandoned.

(30) Foreign Application Priority Data

Jan. 14, 1993 (DE) ..... 43 00 786

(51) Int. Cl.[7] ..... E02D 29/045; E21D 9/00
(52) U.S. Cl. ..... 405/135; 52/396.04
(58) Field of Search ..... 52/396.04, 396.06, 52/402; 404/49, 64, 65, 68; 405/135, 152, 153

(56) References Cited

U.S. PATENT DOCUMENTS

| | | | | |
|---|---|---|---|---|
| 3,680,270 | * | 8/1972 | DeMunck | 405/135 |
| 3,750,411 | * | 8/1973 | Shimizu | 405/135 |
| 4,060,993 | * | 12/1977 | Shimizu | 405/135 |
| 4,824,289 | | 4/1989 | Glang et al. . | |
| 4,946,309 | | 8/1990 | Glang . | |
| 5,074,711 | * | 12/1991 | Glang et al. | 405/152 |
| 5,172,919 | | 12/1992 | Takasaki et al. . | |

FOREIGN PATENT DOCUMENTS

| | | | |
|---|---|---|---|
| 3101332 | | 9/1982 | (DE) . |
| 0270287 | | 6/1988 | (EP) . |
| 0441250 | | 8/1991 | (EP) . |
| 2170561A | | 8/1986 | (GB) . |
| 2193541A | | 2/1988 | (GB) . |
| 2210117A | | 6/1989 | (GB) . |
| 8302240 | * | 1/1985 | (NL) . |
| 1731954 | * | 5/1992 | (SU) . |

* cited by examiner

*Primary Examiner*—Carl D. Friedman
*Assistant Examiner*—Kevin D. Wilkens
(74) *Attorney, Agent, or Firm*—Collard & Roe, P.C.

(57) ABSTRACT

A sealing arrangement includes face walls of two construction parts made of concrete, reinforced concrete or the like, these face walls being pressed against each other, particularly of tunnel tube segments, as well as a strand shaped seal made of elastomeric material for sealing the gap between the construction parts or tunnel tube segments, whereby the seal has a base part which, in relation to the sealing part, is widened on both sides, forming flanges, and which, by means of these flanges and suitable additional anchoring parts, is fastened on one of the two face walls of the construction parts or tunnel tube segments, whereas the sealing part, the latter being joined with the base part in one piece, has a trapezoidal shape, viewed cross-sectionally, and, in relation to the base part, a decreasing width, with lateral flanks tapering off at the same time, and seals the gap when the construction parts or tunnel tube segments are pressed together. In addition, there are at least two, particularly at least three ducts extending in the form of strands.

15 Claims, 3 Drawing Sheets

SEALING ARRANGEMENT

This is a continuation of application(s) Ser. No. 08/302, 644 filed on Sep. 8, 1994 now abandoned. International Application PCT/DE94/00010 filed on Jan. 7, 1994 and which designated the U.S.

BACKGROUND OF THE INVENTION

1. Field of the Invention

The invention relates to a sealing arrangement consisting of face walls, the latter being pressed against each other, of two construction parts made of concrete, reinforced concrete or the like, in particular of tunnel tube segments, as well as of a strand-shaped sealing member consisting of elastomeric material (i.e., of rubber or rubber-like plastic), for sealing the gap between the construction parts or tunnel tube segments, whereby the sealing has a base part which, in relation to the sealing part, is widened on both sides, forming flanges, and which, by means of said flanges and suitable additional anchoring parts, is fastened on one of the two face walls of the construction parts or tunnel tube segments, whereas the sealing part, which is joined with the base part as one piece, has a trapezoidal shape, viewed cross sectionally, namely with decreasing width and tapering of the lateral flanks in relation to the base part, said sealing part sealing the gap when the construction parts or tunnel tube segments are pressed together.

2. The Prior Art

Sealing arrangements of the type specified above are known for all sorts of different application purposes, whereby particularly the scope of application in tunnel construction is considered in detail in the following, whereby the tunnel tube segments are particularly floating-in elements (DE-C 31 01 332).

For sealing the gap between two floating-in elements, one face side is fitted in each case with a sealing frame (face seal) made of elastomeric material. The part piece lowered last is pulled against its predecessor, which is already mounted fixed, until a first sealing is obtained. After the water has then be pumped from the chamber between the two face walls of the floating pieces, the element lowered last is then pushed by the external water pressure against its neigbor with such a force that the face seal undergoes its final compression, and a complete sealing is thus produced.

SUMMARY OF THE INVENTION

Since increasingly exacting requirements are specified for elastomer seals within the framework of worldwide tunnel construction particularly also under the aspect of reliable sealing in earthquake regions (e.g. Japan), the object of the invention consists in making available a highly efficient sealing which is fit for application even under extreme conditions, namely over a long period of time (100 years).

This object is achieved according to the invention in that at least two, particularly at least three ducts are arranged within the trapezoidal sealing part, said ducts extending in the form of a strand.

BRIEF DESCRIPTION OF THE DRAWINGS

Now, the invention is explained in greater detail in the following by reference to the schematic drawings, in which:

FIG. 1) of the sealing frame, whereby the profile body has three strand-like extending ducts;

FIG. 1) of the sealing frame, whereby the profile body has eight strand-like extending ducts;

FIG. 1) of the sealing frame with two structural variations of the frontal surface of the profile body.

In this connection, FIGS. 2 to 4 represent the stressless (i.e., unloaded) conditions of the seals.

DETAILED DESCRIPTION OF PREFERRED EMBODIMENTS

Figure 1:
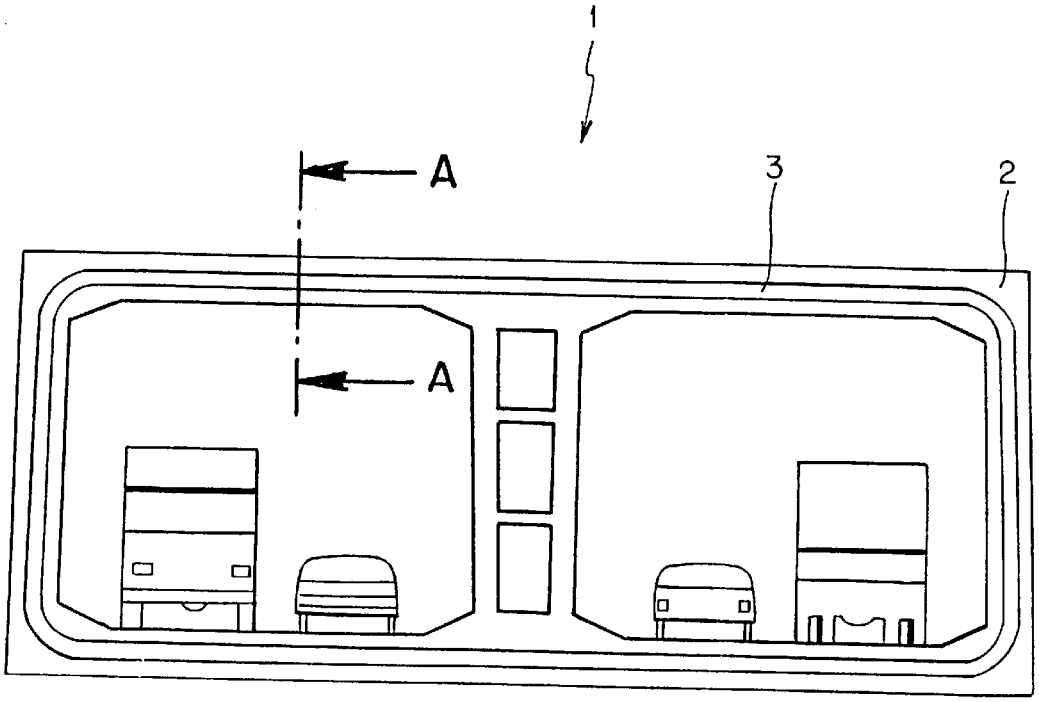
FIG. 1 shows the face side or face wall of a floating-in element with a sealing frame (face seal)

According to FIG. 1, the face side (2) of the floating-in element (1) with two tunnel tubes is provided with a sealing frame (3) consisting of an elastomeric material, whereby the cross section (section line A—A) of the sealing frame is now considered in greater detail in the following on the basis of different profile structures.

Figure 2:
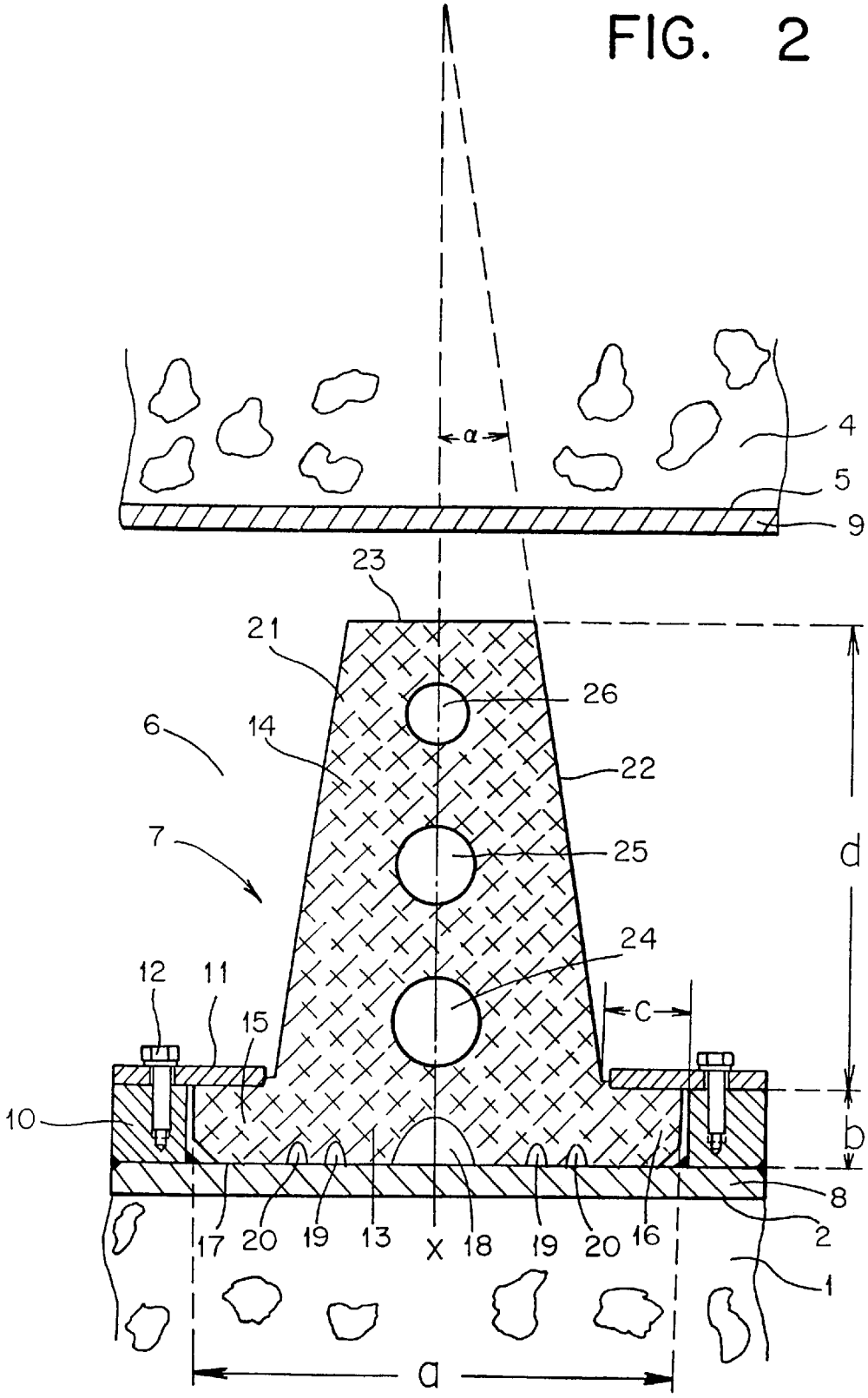
FIG. 2 shows the cross section (section line A—A.

According to FIG. 2, the gap (6) between the two floating-in elements (1,4) consisting of concrete is sealed by means of the seal (7). The face sides (2, 5) of said construction elements each are coated with a metal plate (8, 9), which is anchored in the concrete. The metal plate (8) supports the lateral metal profiles (10) and the metal strips (11), whereby the metal profiles and the metal strips are connected with each other by means of a screw (12). Also L-shaped steel rails (DE-C-31 01 332) can be used as fastening means.

The seal (7) itself has a base part (13) which, in relation to the sealing part (14), is widened on both sides, forming flanges (15, 16). Said flanges are clasped in an anchoring manner by the metal profiles (10) and the metal strips (11). namely in a way such that the center ducts (33, 34; row II) are present within the zone of the longitudinal center plane X, whereas the lateral ducts (35, 36, 37; row I) and (38, 39, 40; row III) are present between said longitudinal center plane and the two lateral flanks (30; 31 respectively), whereby the center ducts (row II) are arranged displaced relative to the lateral ducts (rows I, III) by a spacing e. The following parameters are applicable with respect to the number (m, n) of ducts:

| | |
|---|---|
| Ducts arranged in the center (row II) | m = 2 |
| Ducts arranged laterally (row I and row III, respectively) | n = m + 1 = 3 |

In the present case too, the ducts have a substantially circular cross sectional shape, whereby the two ducts (37, 40) present within the zone of the frontal surface (32) of the trapezoidal sealing part (29) have a smaller diameter than the six ducts (33, 34, 35, 36, 38, 39) arranged beneath.

Figure 3:
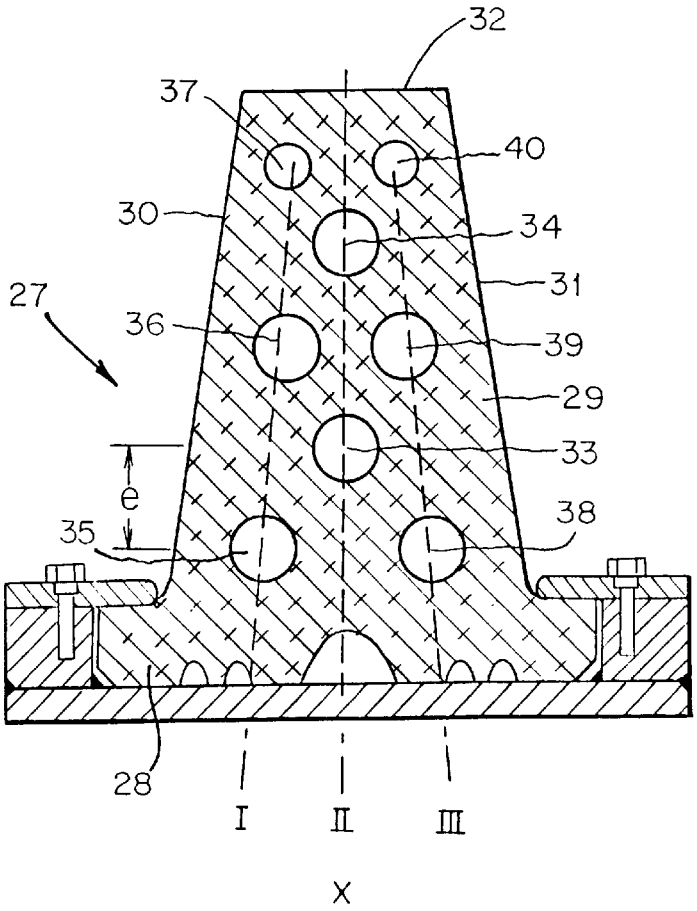
FIG. 3 shows the cross section (section line A—A.
Figure 4:
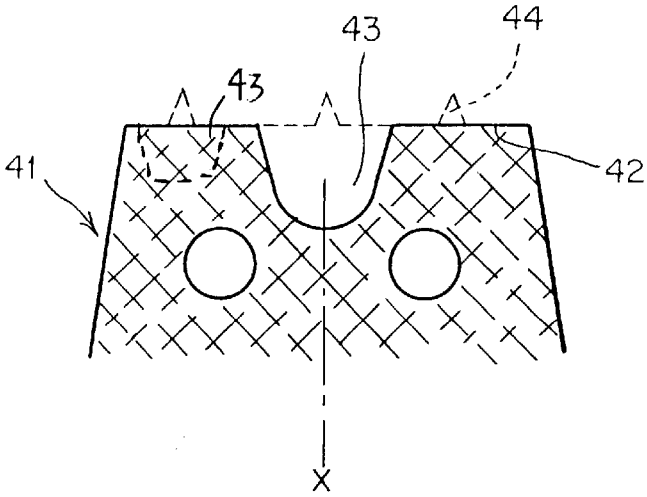
FIG. 4 shows the cross section (section line A—A.

Now, FIG. 4 shows two structural variations of the frontal surface (42) of the sealing (41), whereby reference is made to FIG. 3 with respect to the arrangement of the ducts. According to the one variation, one single flute-type groove (43) is present in the center of the frontal area of the sealing part, namely within the zone of the longitudinal center plane X. A useful alternative is to provide the frontal surface (42) with a plurality of flute-type grooves 43 or toothings (44; dashed lines).

Figure 5:
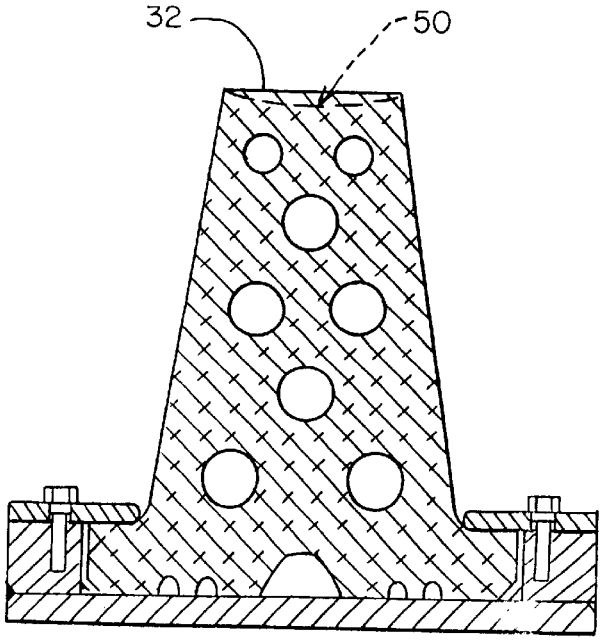
FIG. 5 shows that the frontal surface is a concave sealing surface.

FIG. 5 shows that the frontal surface 32 is a concave sealing surface 50.

Even though the sealing arrangement has been explained primarily on the example of sealing the gap of floating-in elements, the face sealing according to the invention is usable also for sealing the joints of other construction components with an equivalent arrangement principle, where similarly high requirements have to be satisfied with respect to the sealing efficiency.

What is claimed is:

1. Sealing arrangement for tunnel tube segments comprising face walls of two construction parts, said face walls being pressed together;

a strand-shaped seal made of elastomeric material for sealing a gap between the construction parts;

said seal has a sealing part and said seal has a base part which, in relation to the sealing part is widened on both sides, forming flanges and which, by means of said flanges and additional anchoring parts is fastened on one of the two face walls of the construction parts;

said sealing part being joined with the base part as one piece, has a trapezoidal shape, viewed cross-sectionally, in relation to the base part with a decreasing width and lateral flanks tapering off at the same time, and sealing the gap when the construction parts are pressed together;

at least two strand-shaped extending ducts are arranged within the trapezoidal sealing part;

said sealing part having a longitudinal center plane (x);

wherein the base part has a minimum width (a) of 300 mm;

wherein the flanges of the base part have a minimum thickness (b) of 50 mm;

wherein the flanges have a minimum stepping (c) of 40 mm;

wherein the trapezoidal sealing part has a minimum height (d) of 250 mm;

wherein the trapezoidal sealing part has a frontal surface having a substantially mirror-symmetric shape in relation to the longitudinal center plane (X);

wherein the frontal surface has flute-type grooves or toothings;

wherein said ducts are arranged one directly on top of the other exclusively in the center of the trapezoidal sealing part within the zone of the longitudinal center plane (X);

wherein said ducts present are centered about the longitudinal center plane (X) of the frontal surface of the trapezoidal sealing part have a smaller diameter than ducts arranged beneath.

2. Sealing arrangement according to claim 1;

wherein the frontal surface has a shape selected from the group consisting of plane shape and concave shape.

3. Sealing arrangement according to claim 1, wherein one single flute-type groove of said plurality of grooves is arranged in the center of the frontal surface of the trapezoidal sealing part, and is centered about the longitudinal center plane (X).

4. Sealing arrangement according to claim 1, wherein the lateral flanks of the trapezoidal sealing part extend at the same, angle and are mirror-symmetrically in relation to the longitudinal center plane (X).

5. Sealing arrangement according to claim 1, wherein the lateral flanks of the trapezoidal sealing part extend at an angle $\alpha$ of 5° to 15° based on the longitudinal center plane (X).

6. Sealing arrangement according to claim 1, where each duct has a substantially circular cross-sectional shape.

7. Sealing arrangement according to claim 1, wherein the sealing part has a Shore A hardness ranging from 50° to 80°.

8. Sealing arrangement according to claim 1, wherein said additional anchoring parts comprise a metal plate on said construction part;

a lateral metal profile supported on said metal plate;

a metal strip on said metal profile and on said flanges;

a fastener means which attaches said metal strip to said metal profile without contacting said flanges; and whereby said flanges are firmly held in place adjacent to said metal plate to fasten said seal on said face wall of said construction part.

9. Sealing arrangement according to claim 1, further comprising at least three flute-type grooves present on the bottom side of the base part, one of the flute-type grooves is centered about the longitudinal center plane (X) and is wider and deeper than the flute-type grooves arranged laterally thereof;

said laterally arranged grooves extending substantially mirror-symmetrically relative to the center flute-type groove.

10. Sealing arrangement according to claim 9, wherein the flute-type groove arranged in the center is at least 30% wider and 30% deeper than the flute-type grooves arranged laterally thereof.

11. Sealing arrangement according to claim 1, where there are additional ducts which are present and distributed within the total cross-sectional area of the trapezoidal sealing part in a substantially mirror-symmetric arrangement in relation to the longitudinal center plane (X).

12. Sealing arrangement according to claim 11, wherein all the ducts are arranged in three rows (rows I, II, III) based on the longitudinal center plane (X), and comprising center ducts (row II) present within the zone of the longitudinal center plane (X), and lateral ducts (row I) and (row III) present between said longitudinal center plane and the two lateral flanks;

whereby said center ducts (row II) are arranged displaced relative to said lateral ducts (rows I, III) by a spacing (e).

13. Sealing arrangement according to claim 12, wherein (m) is the number of ducts arranged in the center (row II); and wherein (n) is the number of ducts arranged laterally (rows I and III); and wherein (n)=(m)+1.

14. Sealing arrangement for tunnel tube segments comprising face walls of two construction parts, said face walls being pressed together;

a strand-shaped seal made of elastomeric material for sealing a gap between the construction parts;

said seal has a sealing part and said seal has a base part which, in relation to the sealing part is widened on both sides, forming flanges and which, by means of said flanges and additional anchoring parts is fastened on one of the two face walls of the construction parts;

said sealing part being joined with the base part as one piece, has a trapezoidal shape, viewed cross-sectionally, in relation to the base part with a decreasing width and lateral flanks tapering off at the same time, and sealing the gap when the construction parts are pressed together;

at least two strand-shaped extending ducts are arranged within the trapezoidal sealing part;

said sealing part having a longitudinal center plane (X);

wherein the base part has a minimum width (a) of 300 mm;

wherein the flanges of the base part have a minimum thickness (b) of 50 mm;

wherein the flanges have a minimum stepping (c) of 40 mm;

wherein the trapezoidal sealing part has a minimum height (d) of 250 mm;

at least three strand-shaped extending flute-type grooves present on the bottom side of the base part;

one of the flute-type grooves is centered about the longitudinal center plane (X) and is wider and deeper than the flute-type grooves arranged laterally thereof;

said laterally arranged grooves extending substantially mirror-symmetrically relative to the center flute-type groove;

wherein the flute-type groove arranged in the center is at least 30% wider and deeper than the flute-type grooves arranged laterally thereof;

wherein the trapezoidal sealing part has a frontal surface having a substantially mirror-symmetric shape in relation to the longitudinal center plane (X);

wherein the lateral flanks of the trapezoidal sealing part extend at the same angles, and are mirror-symmetrically in relation to the longitudinal center plane (X);

wherein the lateral flanks of the trapezoidal sealing part extend at an angle ($\alpha$) of 5° to 15° based on the longitudinal center plane (X); and wherein said ducts are arranged one directly on top of the other exclusively in the center of the trapezoidal sealing part within the zone of the longitudinal center plane (X).

15. Sealing arrangement for tunnel tube segments comprising face walls of two construction parts, said face walls being pressed together;

a strand-shaped seal made of elastomeric material for sealing a gap between the construction parts;

said seal has a sealing part and said seal has a base part which, in relation to the sealing part is widened on both sides, forming flanges and which, by means of said flanges and additional anchoring parts is fastened on one of the two face walls of the construction parts;

said sealing part being joined with the base part as one piece, has a trapezoidal shape, viewed cross-sectionally, in relation to the base part with a decreasing width and lateral flanks tapering off at the same time, and sealing the gap when the construction parts are pressed together;

at least two strand-shaped extending ducts are arranged within the trapezoidal sealing part;

said sealing part having a longitudinal center plane (X);

wherein the base part has a minimum width (a) of 300 mm;

wherein the flanges of the base part have a minimum thickness (b) of 50 mm;

wherein the flanges have a minimum stepping (c) of 40 mm;

wherein the trapezoidal sealing part has a minimum height (d) of 250 mm;

at least three strand-shaped extending flute-type grooves present on the bottom side of the base part;

one of the flute-type grooves centered about the longitudinal center plane (X) and is wider and deeper than the flute-type grooves arranged laterally thereof;

said laterally arranged grooves extending substantially mirror-symmetrically relative to the center flute-type groove;

wherein the flute-type groove arranged in the center is least 30% wider and deeper than the flute-type grooves arranged laterally thereof;

wherein the trapezoidal sealing part has a frontal face having a substantially mirror-symmetric shape in relation to the longitudinal center plane (X);

wherein the lateral flanks of the trapezoidal sealing part extend at the same angles, and are mirror-symmetrically in relation to the longitudinal center plane (X);

wherein the lateral flanks of the trapezoidal sealing part extend at an angle ($\alpha$) of 5° to 15° based on the longitudinal center plane (X);

wherein the ducts are present distributed within the total cross-sectional area of the trapezoidal sealing part in a substantially mirror-symmetric arrangement in relation to the longitudinal center plane (X);

wherein all the ducts are arranged in three rows (rows I, II, III) based on the longitudinal center plane (X), and comprising center ducts (row II) present within the zone of the longitudinal center plane (X), and lateral ducts (row I) and (row III) present between said longitudinal center plane and the two lateral flanks;

whereby the center ducts (row II) are arranged displaced relative to the lateral ducts (rows I, III) by a spacing (e).

* * * * *